US010041505B2

(12) United States Patent
Stevens et al.

(10) Patent No.: US 10,041,505 B2
(45) Date of Patent: Aug. 7, 2018

(54) AIRFLOW ASSEMBLY HAVING IMPROVED ACOUSTICAL PERFORMANCE

(75) Inventors: William M. Stevens, Maynard, MA (US); Mark D. Caplan, Westborough, MA (US); Yoonshik Shin, Lexington, MA (US); Robert J. Van Houten, Winchester, MA (US)

(73) Assignees: Robert Bosch LLC, Broadview, IL (US); Robert Bosch GmbH, Stuttgart (DE)

( * ) Notice: Subject to any disclaimer, the term of this patent is extended or adjusted under 35 U.S.C. 154(b) by 1579 days.

(21) Appl. No.: 13/523,715

(22) Filed: Jun. 14, 2012

(65) Prior Publication Data

US 2012/0321474 A1 Dec. 20, 2012

Related U.S. Application Data

(60) Provisional application No. 61/496,915, filed on Jun. 14, 2011.

(51) Int. Cl.
*F04D 29/66* (2006.01)
*F04D 29/52* (2006.01)
(Continued)

(52) U.S. Cl.
CPC ..... *F04D 29/526* (2013.01); *F01P 5/06* (2013.01); *F04D 29/545* (2013.01)

(58) Field of Classification Search
CPC ..... F04D 29/54; F04D 29/66; F04D 29/663; F04D 29/526; F04D 29/545; F01P 5/06
(Continued)

(56) References Cited

U.S. PATENT DOCUMENTS 5,660,149 A * 8/1997 Lakerdas et al. ..... 123/41.44
5,881,685 A 3/1999 Foss et al.
(Continued)

FOREIGN PATENT DOCUMENTS

CN 1584343 A 2/2005
CN 101096968 A 1/2008
(Continued)

OTHER PUBLICATIONS

International Search Report in corresponding PCT application (i.e., PCT/US2012/042520), dated Dec. 6, 2012 (13 pages).
(Continued)

*Primary Examiner* — Woody Lee, Jr.
*Assistant Examiner* — Maxime Adjagbe
(74) *Attorney, Agent, or Firm* — Maginot Moore & Beck LLP

(57) ABSTRACT

An airflow assembly includes a fan, a shroud, a plurality of ribs, and a fan support. The fan has a number of fan blades. The shroud includes (i) a plenum defining a plenum opening located adjacent to the number of fan blades, and (ii) a barrel extending from the plenum so as to surround the plenum opening. The plenum further defines at least one airflow opening spaced apart from the plenum opening. Each of the plurality of ribs extends inwardly from the barrel. The fan support is attached to the plurality of ribs and is configured to support the fan. The at least one airflow opening is not an attachment structure or a guiding structure, is not configured to receive a fastening member, and does not function as a water drain.

19 Claims, 11 Drawing Sheets

(51) Int. Cl.
*F01P 5/06* (2006.01)
*F04D 29/54* (2006.01)

(58) Field of Classification Search
USPC ..... 415/211.2, 213.2, 173.1, 220, 223, 224, 415/228
See application file for complete search history.

(56) References Cited

U.S. PATENT DOCUMENTS

| | | | | |
|---|---|---|---|---|
| 2006/0048924 | A1* | 3/2006 | Desai | 165/148 |
| 2008/0072851 | A1 | 3/2008 | McLennan | |
| 2009/0269196 | A1 | 10/2009 | Hsu et al. | |

FOREIGN PATENT DOCUMENTS

| | | | |
|---|---|---|---|
| CN | 201250799 | Y | 6/2009 |
| CN | 102086874 | A | 6/2011 |

OTHER PUBLICATIONS

English Translation of Chinese Office Action for Corresponding Chinese Application 201280034879.0 (6 pages).
Chinese Search Report and Written Opinion corresponding to Chinese Application No. 2012800348790.0 (7 pages).

* cited by examiner

AIRFLOW ASSEMBLY HAVING IMPROVED ACOUSTICAL PERFORMANCE

This application claims the benefit of U.S. Provisional Application Ser. No. 61/496,915, filed Jun. 14, 2011, the disclosure of which is incorporated herein by reference in its entirety.

FIELD

This patent relates generally to the field of airflow assemblies for use with an automotive engine cooling system, and more particularly to an airflow assembly exhibiting an improved acoustical performance.

BACKGROUND

Motor vehicles powered by an internal combustion engine typically include a liquid cooling system that maintains the engine at an operating temperature. The cooling system typically includes a liquid coolant, a heat exchanger, and an airflow assembly. A pump circulates the coolant through the engine and the heat exchanger, which is typically referred to as a radiator. The coolant extracts heat energy from the engine. As the coolant flows through the radiator, the heat energy extracted by the coolant is dissipated to atmosphere, thereby preparing the coolant to extract additional heat energy from the engine. To assist in dissipating the heat energy of the coolant, the radiator typically includes numerous fins that define many airway channels. As the vehicle is driven, ambient temperature air from atmosphere is directed through the airway channels to dissipate the heat energy.

The airflow assembly includes a shroud and a fan. Typically, the shroud is positioned to cause the ambient temperature air from atmosphere to flow through the airway channels defined by the radiator, instead of blowing around the sides of the radiator. The fan is typically connected to the shroud. When the fan is operated it assists in moving air through the airway channels of the radiator. Operation of the fan, however, typically causes the airflow assembly to generate some noise that may be objectionable to some users.

Accordingly, it is desirable to improve the airflow assembly so that the noise generated by the operating airflow assembly is less objectionable to most users.

SUMMARY

According to one embodiment of the disclosure, an airflow assembly includes a fan, a shroud, a plurality of ribs, and a fan support. The fan has a number of fan blades. The shroud includes (i) a plenum defining a plenum opening located adjacent to the number of fan blades, and (ii) a barrel extending from the plenum so as to surround the plenum opening. The plenum further defines at least one airflow opening spaced apart from the plenum opening. Each of the plurality of ribs extends inwardly from the barrel. The fan support is attached to the plurality of ribs and is configured to support the fan. The at least one airflow opening is not an attachment structure or a guiding structure, is not configured to receive a fastening member, and does not function as a water drain.

According to another embodiment of the disclosure, an airflow assembly includes a fan, a shroud, a plurality of ribs, and a fan support. The fan has a number of fan blades. The fan is configured to rotate the number of fan blades so as to generate a flow of air. The shroud includes (i) a plenum defining a plenum opening configured to pass at least a first portion of the flow of air therethrough, and (ii) a barrel extending from the plenum so as to define a barrel space that is aligned with the plenum opening. The plenum includes a rim structure that defines at least one airflow opening configured to pass at least a second portion of the flow of air therethrough. The plenum opening is spaced apart from the at least one airflow opening. Each of the plurality of ribs extends inwardly from the barrel. The fan support is attached to the plurality of ribs and is configured to support the fan. The at least one airflow opening is spaced apart from the barrel. The at least one airflow opening is defined solely by the rim structure.

BRIEF DESCRIPTION OF THE FIGURES

The above-described features and advantages, as well as others, should become more readily apparent to those of ordinary skill in the art by reference to the following detailed description and the accompanying figures in which.

DETAILED DESCRIPTION

Figure 1:
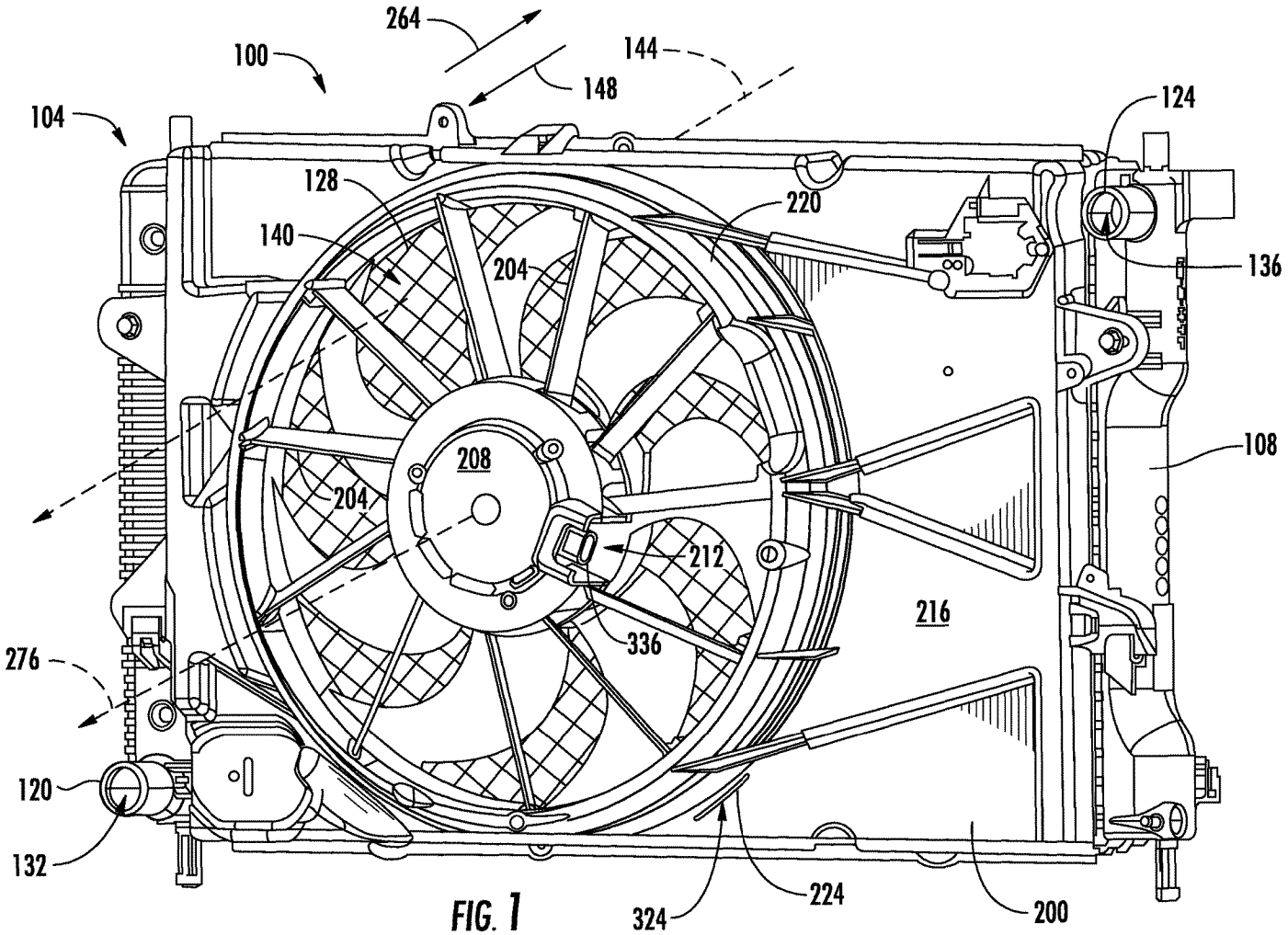
FIG. 1 is a perspective view of a downstream side of an airflow assembly and a heat exchanger, as described herein.

For the purpose of promoting an understanding of the principles of the disclosure, reference will now be made to the embodiments illustrated in the drawings and described in the following written specification. It is understood that no limitation to the scope of the disclosure is thereby intended. It is further understood that the disclosure includes any alterations and modifications to the illustrated embodiments and includes further applications of the principles of the disclosure as would normally occur to one skilled in the art to which this disclosure pertains.

Figure 2:
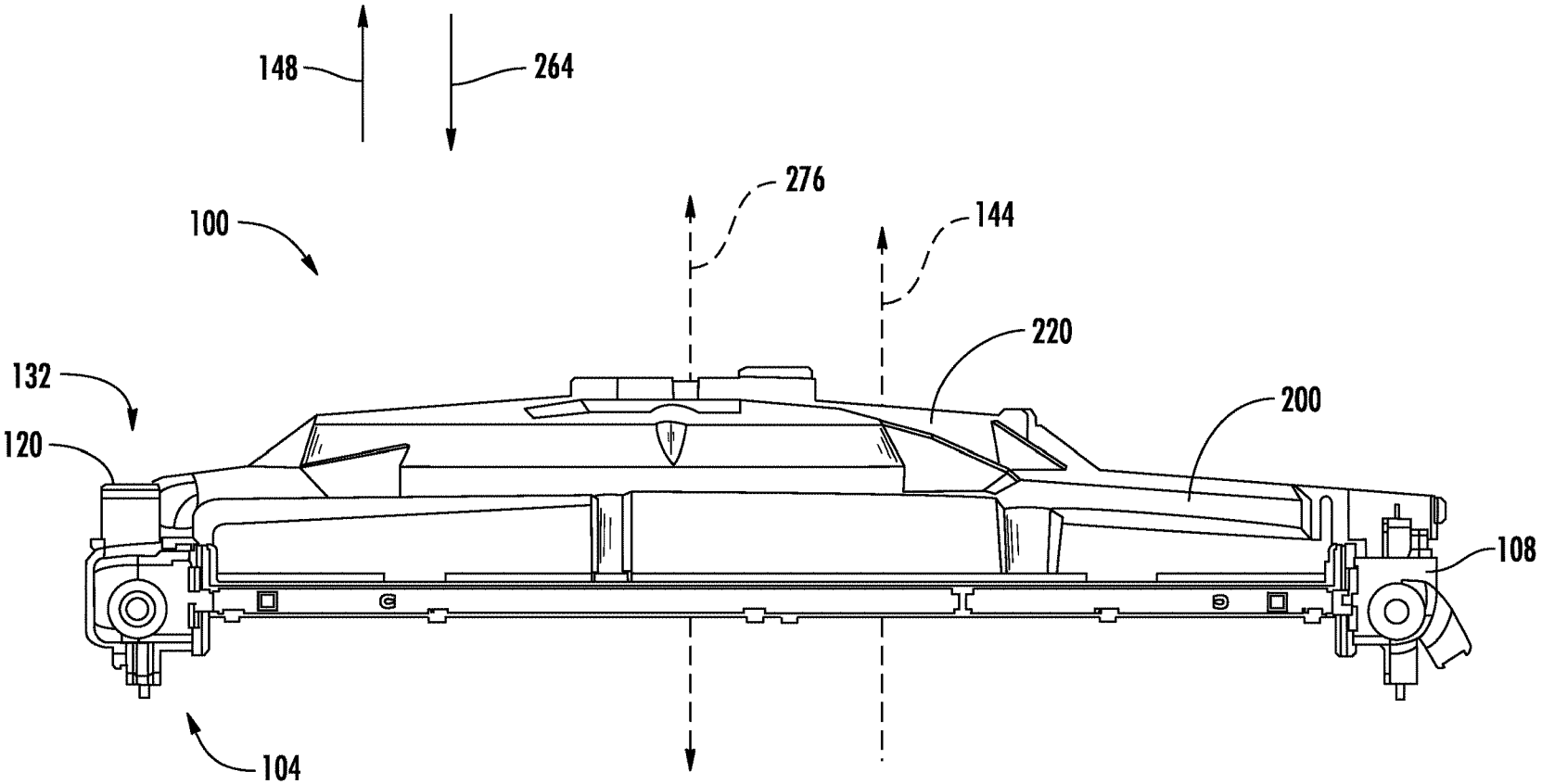
FIG. 2 is a bottom elevational view of the airflow assembly and the heat exchanger of FIG. 1.

As shown in FIGS. 1 and 2, an airflow assembly 100 is connected to a heat exchanger 104. The heat exchanger 104 includes a body 108 that defines a generally rectangular periphery. The body 108 includes an inlet structure 120, an outlet structure 124, and numerous fins 128 (only shown in FIG. 1). The inlet structure 120 defines an inlet orifice 132, and the outlet structure 124 defines an outlet orifice 136. The inlet orifice 132 is fluidly connected to the outlet orifice 136 through the body 108, in a way known to those of ordinary skill in the art. The fins 128 define numerous airway channels 140 (only shown in FIG. 1 and shown enlarged for clarity) that extend through the body 108, thereby enabling an airflow 144 to pass through the body 108. In FIGS. 1 and 2, the airflow 144 is shown as an arrow extending through one of the airway channels 140. A substantially identical airflow 144 passes through each of the many airway channels 140 formed in the heat exchanger 104.

Typically, a liquid coolant (not shown) is pumped through the heat exchanger 104 from the inlet structure 120 to the outlet structure 124. The airflow 144, which typically advances in a downstream direction 148, causes the heat exchanger 104 to cool the liquid coolant. The heat exchanger 104 may alternatively be any other type of heat exchanger, as known to those of ordinary skill in the art.

Figure 3:
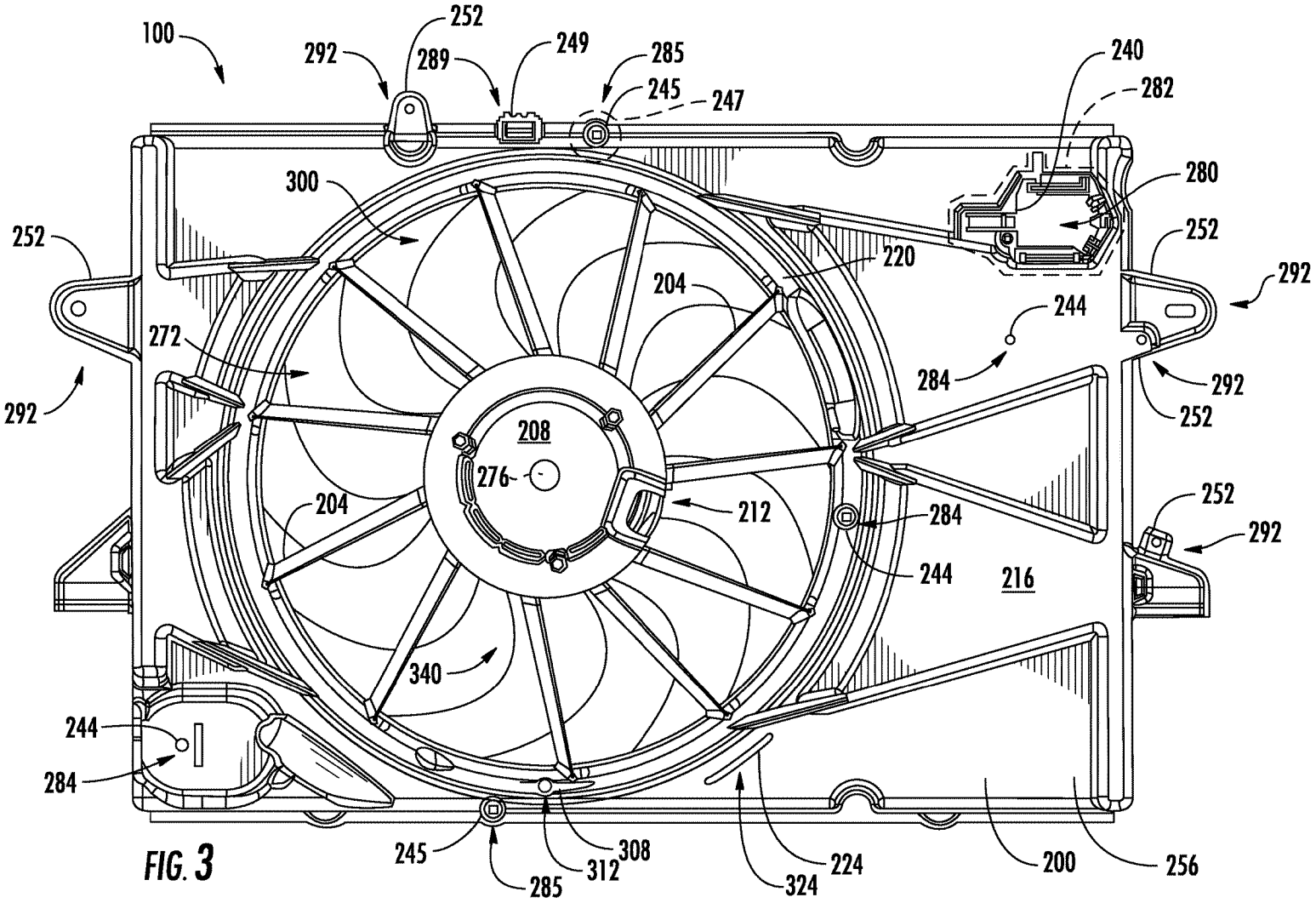
FIG. 3 is an elevational view of the downstream side (showing an exterior surface) of the airflow assembly of FIG. 1, the heat exchanger is not shown for clarity of viewing.
Figure 4:
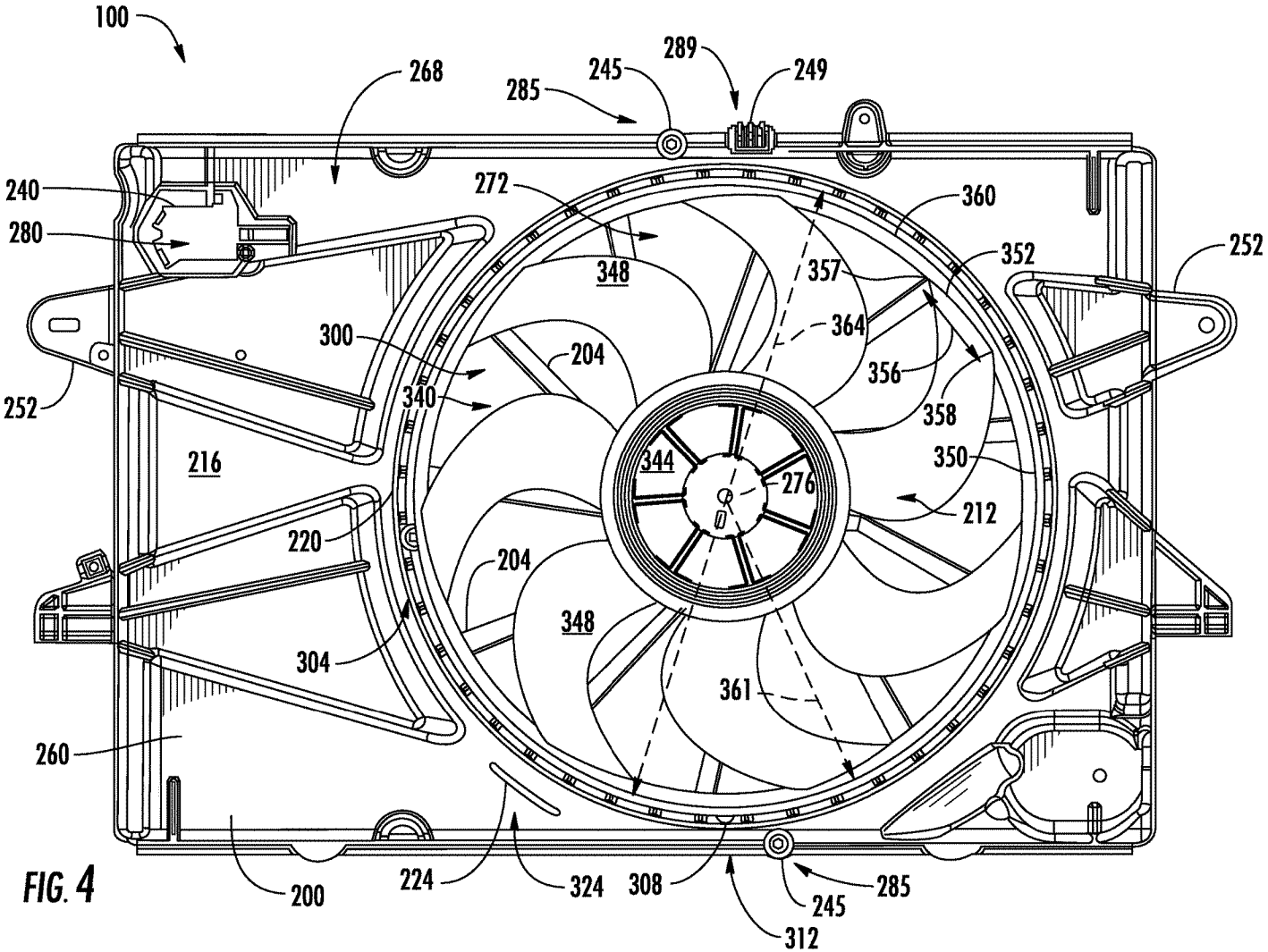
FIG. 4 is an elevational view of an upstream side (showing an interior surface) of the airflow assembly of FIG. 1, the heat exchanger is not shown for clarity of viewing.

As shown in FIGS. 3 and 4, the airflow assembly 100 includes a shroud 200, a plurality of ribs 204, a fan support 208 (FIG. 3), and a fan 212. The shroud 200 includes a plenum 216 and a barrel 220. The plenum 216 defines a plenum opening 272, an exterior surface 256 (FIG. 3), an interior surface 260 (FIG. 4), and includes a rim structure 224, a component structure 240, attachment structures 244, bumper holders 245, a guiding structure 248, an attachment feature 249, and connection tabs 252. The exterior surface 256 defines a generally rectangular periphery that corresponds at least in part to the rectangular periphery of the body 108. The interior surface 260 is generally concave.

The plenum opening 272 is centered about an axis 276. The axis 276 is parallel to the downstream direction 148 and an upstream direction 264 (FIG. 1), which is opposite of the downstream direction.

With reference to FIG. 4, the interior surface 260 of the plenum 216 defines a plenum space 268. The plenum space 268 is an air space between the body 108 and the interior surface 260. The exterior surface 256 is spaced apart from the plenum space 268. When the airflow 144 passes through the body 108 it enters the plenum space 268. The interior surface 260 guides the airflow 144 to the plenum opening 272.

Figure 9:
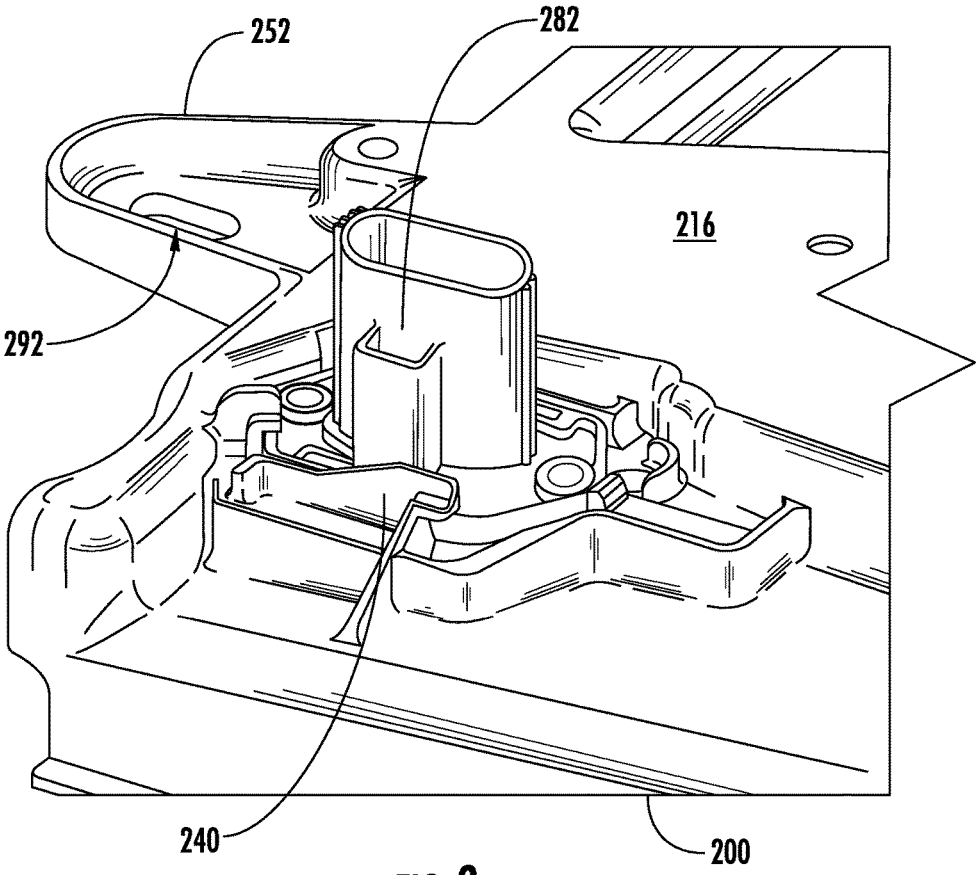
FIG. 9 is a perspective view of a portion of the airflow assembly of FIG. 1 showing a component positioned in a component opening of the airflow assembly.

As shown in FIG. 3, the component structure 240 defines a component opening 280 through the plenum 216 to the plenum space 268. The component opening 280 receives a component 282 (shown in FIG. 9 and shown in phantom in FIG. 3) and connects the component to the component structure 240. When the component 282 is connected to the component structure 240 (as shown in FIG. 9) the component occludes at least a portion of the component opening 280. To the extent that some portion of the component opening 280 would not be occluded by the component 282, the resulting gap between the component and the component structure 240 that defines the component opening 280 would at least be partially defined by the component.

Figure 10:
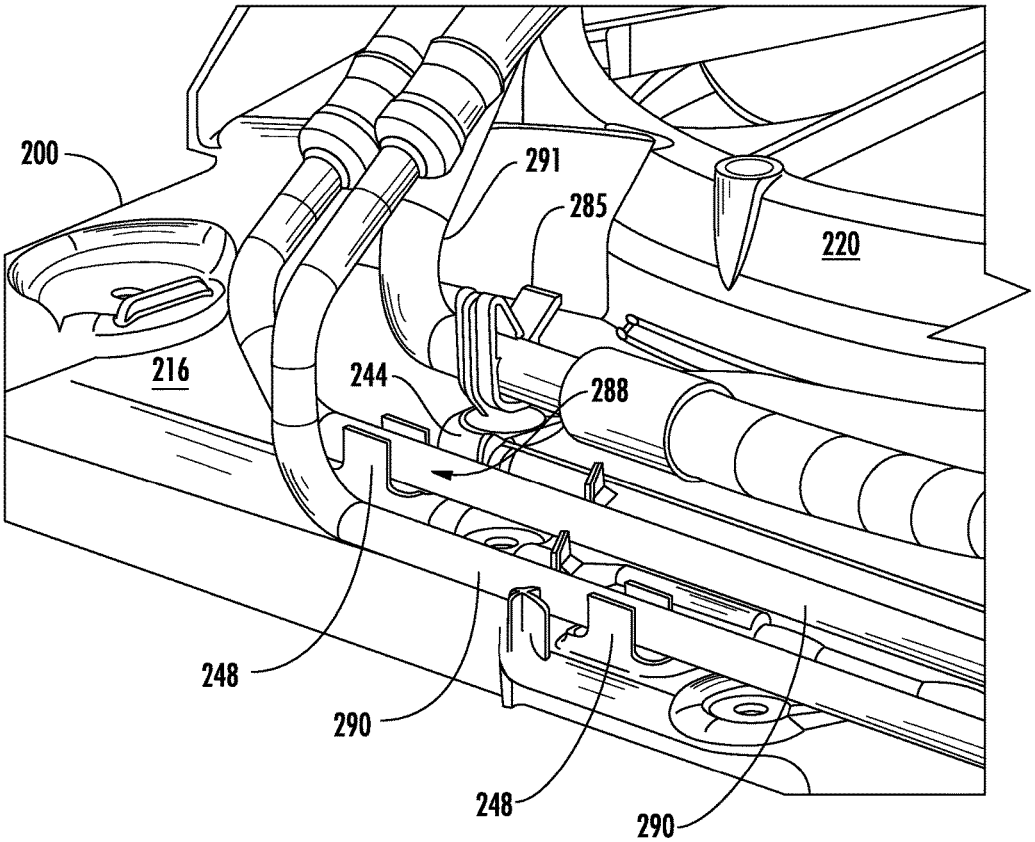
FIG. 10 is a perspective view of a portion of an alternative embodiment of the airflow assembly of FIG. 1 showing a guiding structure of the airflow assembly guiding a tube.

The attachment structures 244 define an opening 284 through the plenum 216 or the barrel 220 to the plenum space 268. A fastening member, a clip, a snubber, and/or any other type of fastener extends through the opening 284. As shown in FIG. 10 (which shows a portion of another embodiment of the shroud 200), a fastener 285 is shown positioned in an attachment opening 284 (occluded in FIG. 9) of an attachment structure 244. The fastener 285 receives and positions a tube 291. The fastener 285 completely fills the opening 284. However, to the extent that some portion of the opening 284 would not be occluded by the fastener 285 (or any other type of fastener), the resulting gap between the fastener and the attachment structure 244 that defines the opening 284 would at least be partially defined by the fastener.

With continued reference to FIG. 10, the guiding structure 248 defines an opening 288 through the plenum 216 to the plenum space 268. The guiding structure 248 receives an element 290 that is to be guided, such as a tube, a wire, a wire conduit, a portion of a coolant overflow tank, and/or any other component to be guided. When the element 290 is received by the guiding structure 248, the element occludes at least a portion of the opening 288. To the extent that some portion of the opening 288 would not be occluded by the element 290, the resulting gap between the element and the guiding structure 248 that defines the opening 288 would at least be partially defined by the element.

As shown in FIG. 3, the bumper holders 245 define an opening 285 through the plenum 216 or the barrel 220 to the plenum space 268. A bumper, snubber, and/or any other type of fastener extends (referred to generally as a fastener) through the opening 285. As shown in FIG. 3, a bumper 247 (shown in phantom in FIG. 3) is received by the bumper holder 245 and is at least partially positioned within the opening 285. The bumper 247 limits movement of the shroud 200 relative to the heat exchanger 104. When the bumper 247 extends through the opening 285 the bumper occludes at least a portion of the opening 285. To the extent that some portion of the opening 285 would not be occluded by the bumper 247, the resulting gap between the bumper and the bumper holder 245 that defines the opening 285 would at least be partially defined by the bumper.

The attachment feature 249 defines an opening 289 through the plenum 216 or the barrel 220 to the plenum space 268. The attachment feature 249 cooperates with the heat exchanger 104 to connect the shroud 200 to the heat exchanger. When the shroud 200 is connected to the heat exchanger 104, the body 108 occludes at least a portion of the opening 289. To the extent that some portion of the opening 289 would not be occluded by the body 108, the resulting gap between the body and the attachment feature 249 that defines the opening 289 would at least be partially defined by the body.

The connection tabs 252 extend from the plenum 216 and define connection openings 292. The connection openings 292 are spaced apart from the plenum space 268. Accordingly, the connection openings 292 do not affect the airflow 144 and the airflow 144 does not pass through the connection openings. With reference to FIG. 1, fastening members 296 extend through some of the connection openings 292 to connect the shroud 200 to the heat exchanger.

As shown in FIGS. 3 and 4, the barrel 220 extends from the plenum 216 in the downstream direction 148 (FIGS. 1 and 2) so as to surround the plenum opening 272. The barrel 220 is generally cylindrical and is centered about the axis 276. The barrel 220 defines a barrel space 300, which is a generally cylindrical space that is bounded by the barrel and extends along the axis 276. As shown in FIG. 4, the barrel 220 also defines a generally cylindrical U-shaped barrel channel 304.

The barrel 220 includes a water drain structure 308 that defines a water drain opening 312. The water drain opening 312 enables water and other liquid fluids that may collect in the barrel channel 304 to exit the barrel channel. In other embodiments, the barrel 220 may not include a water drain structure 308.

Figure 5:
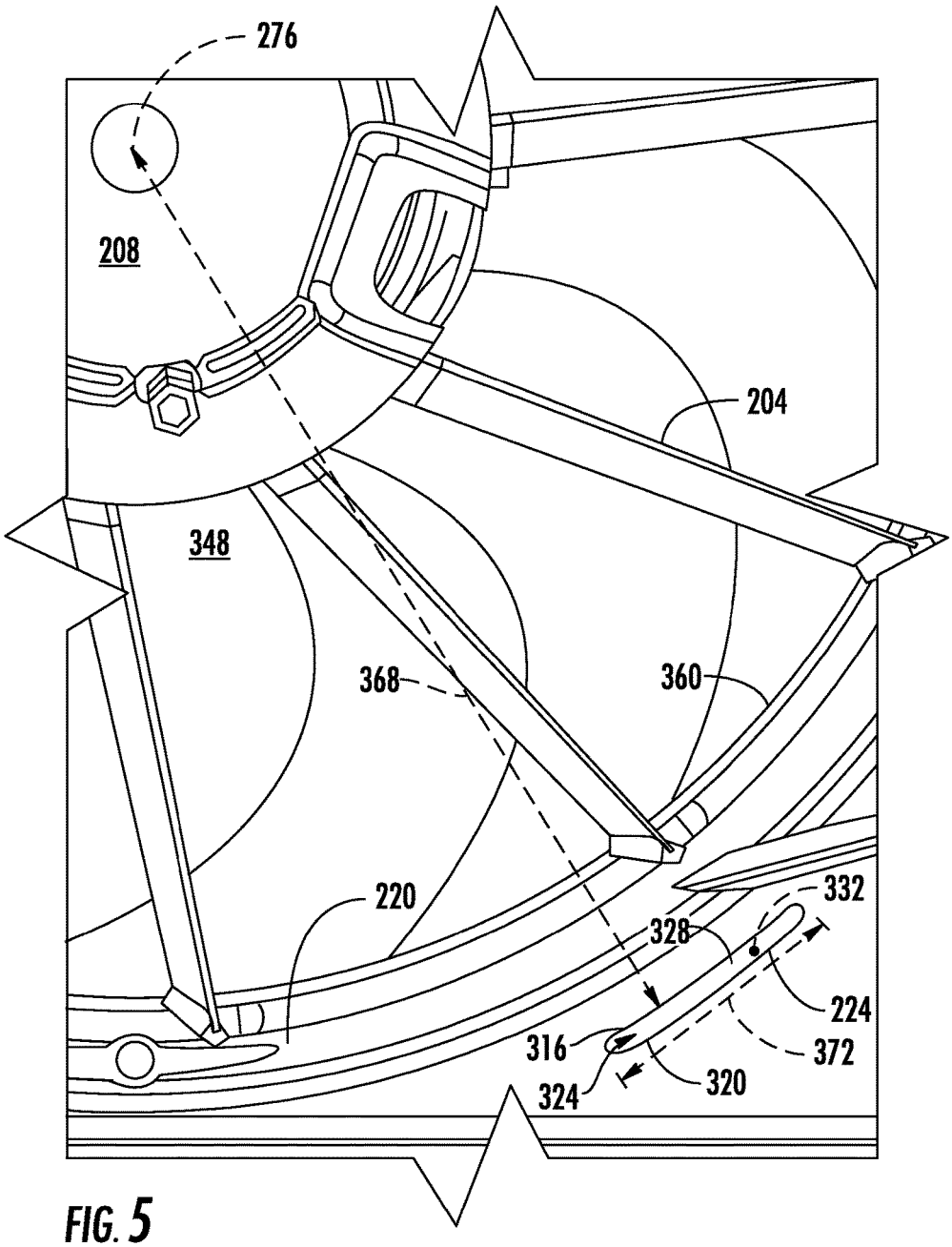
FIG. 5 is an elevational view of a portion of the downstream side of the airflow assembly of FIG. 1, showing an airflow opening of the airflow assembly.

As shown in FIG. 5, the rim structure 224 defines an airflow opening 324 through the plenum 216 to the plenum space 268. The rim structure 224 includes an inner edge 316 and an outer edge 320 that are spaced apart from each other. The outer edge 320 is generally parallel to the inner edge 316. The distance between the outer edge 320 and the inner edge 316 is referred to as a radial extent 328 of the airflow opening 324 with respect to the axis 276.

The airflow opening 324 is spaced apart from the barrel 220 and the plenum opening 272. The airflow opening 324 extends through the plenum 216 from the interior surface 260 to the exterior surface 256.

The airflow opening 324 is defined solely by the rim structure 224, in that no other component contributes to defining the airflow opening except for the rim structure. This distinguishes the airflow opening 324 from the opening 280 defined by the component structure 240, the openings 284 defined by the attachment structures 244, and the opening 288 defined by the guiding structure 248, since each of these openings 280, 284, 288 receives a component, fastener, and/or element that at least partially defines any opening through which the airflow 144 may advance.

The airflow opening 324 is not a component structure 240, an attachment structure 244, or a guiding structure 248. Accordingly, fastening members, other components, and/or elements do not extend through the airflow opening 324 during operation of the airflow assembly 100. Additionally, the rim structure 224 is not a water drain structure 308, and the airflow opening 324 does not function as a water drain.

As shown in FIG. 3, the ribs 204 extend generally radially inwardly from the barrel 220 toward the axis 276. In an alternative embodiment, the ribs 204 extend generally radially inward from the plenum 216.

The fan support 208 is attached the ribs 204 and is at least partially positioned in the barrel space 300. The fan support 208 supports any type of fan 212 that is usable with the airflow assembly 100. The fan support 208 positions the fan 212 at least partially in the barrel space 300.

The shroud 200, the ribs 204, and the fan support 208 are all integrally formed from injection molded thermoplastic.

As shown in FIG. 4, the fan 212 includes a motor 336 (FIG. 1) and a blade assembly 340. The motor 336 rotates the blade assembly 340 in a path of movement about the axis 276. The motor 336 may be any type of motor including, but not limited to, electric motors (such as electronically commutated motors) and hydraulic motors.

The blade assembly 340 includes a hub 344, seven (7) fan blades 348, and a band 350. The hub 344 is centered about the axis 276. The blades 348 extend radially outward from the hub 344. The band 350 is connected to a terminal edge 352 of each of the blades 348. In other embodiments, the blade assembly 340 may not include the band 350 and/or may include a different number of the blades 348.

Each of the blades 348 includes a terminal end 352 that defines a fan blade tip chord 356. The fan blade tip chord 356 is a length of the terminal end 352 that extends from an end point 357 to an end point 358 of the terminal end.

The blade assembly 340 defines an average azimuthal blade tip spacing, which is equal to 360 degrees divided by the number of the blades 348. In the embodiment of FIG. 4, the average azimuthal blade tip spacing is equal to approximately 51.4 degrees.

Rotation of the blade assembly 340 causes the blades 348 to generate a flow of air that includes the airflow 144. Typically the flow of air, including the airflow 144, advances in the downstream direction 148. Since, the plenum opening 272 is located adjacent to the blades 348, the airflow 144 advances through the plenum opening from inside of the plenum space 268 to outside of the plenum space.

In the illustrated embodiment, as the blade assembly 340 rotates in a path of movement about the axis 276 it is a generatrix, in that it defines a cylinder 360 that is congruent with the band 350. The cylinder 360 has a diameter 364, and the diameter divided by two is equal to a maximum radial extent 361 (FIG. 4, referred to as Rmax) of the blade assembly 340. In other embodiments, rotation of the blade assembly 340 about the axis 276 may not define a generally cylindrical shape.

As shown in FIG. 5, the position of the rim structure 224 and the dimensions of the airflow opening 324 are, in some embodiments, based at least in part on the dimensions of the blade assembly 340. For example, the inner edge 316 is spaced apart from the axis 276 a radial distance 368, which is greater than or equal to approximately 100% of the maximum radial extent 361 and less than or equal to approximately 150% of the maximum radial extent (i.e. 1.5 Rmax). According to the above relationship, the airflow openings 324 are located within a generally annulus-shaped portion of the plenum 216 having an inner radius approximately equal to the maximum radial extent and an outer radius that is greater than the maximum radial extent. A ratio of the radial extent 328 of airflow opening 324 to the maximum radial extent 361 of the blade assembly is greater than or equal to 0.03 and is less than or equal to 0.30. Additionally, the airflow opening 324 defines an azimuthal extent 372, which is a length of the airflow opening measured along an arc that is congruent with the cylinder 360. The azimuthal extent 372 is greater than or equal to 10% of the fan blade tip chord 356 and less than or equal to the blade tip spacing S.

The above relationships expressed between the dimensions of the airflow opening 324 and the dimensions of the blade assembly 340 ensure that the airflow opening improves the acoustical performance of the airflow assembly 100 during operation of the fan 212.

In operation, the airflow opening 324 changes the characteristics of the noise that is generated by the airflow assembly during operation of the fan 212. To begin, the airflow assembly 100 is connected to the heat exchanger 104 (as shown in FIG. 1). The heat exchanger 104 is typically part of an automobile or other vehicle (not shown). Next, the motor 336 is energized to cause the blade assembly 340 to rotate. Rotation of the blade assembly 340 generates the flow of air that includes the airflow 144.

The airflow 144 advances in the downstream direction 148 through the body 108 of the heat exchanger 104 and into the plenum space 268. Next, the airflow 144 advances through the plenum opening 272 and the barrel 220 to outside of the plenum space 268.

As the airflow 144 passes through the plenum opening 272 and the barrel 220 it causes a "jet" of air, referred to an airflow 332, through the airflow opening 324. The airflow 332, which is a portion of the flow of air generated by the fan 212, is shown in FIG. 5 as extending into and out of the page. The airflow 332 may advance in either the upstream direction 264 or the downstream direction 148 through the airflow opening 324. Typically, the airflow 144 creates a region of low air pressure within the plenum space 268 as compared to the air pressure outside of the plenum space. This differential in air pressure causes the airflow 332 to advance in the upstream direction 264 from outside of the plenum space 268 to the plenum space 268 through the airflow opening 324; therefore, the airflow is recirculated through the plenum space.

The airflow 332 affects the airflow 144 to change the noise that is generated by the airflow assembly 100. In particular, the airflow 332 improves the acoustical performance of the airflow assembly 100 by canceling certain frequencies of noise. The frequencies that are canceled are a function of the number of the airflow openings 324, the radial extent 328, the radial distance 368, and the azimuthal extent 372, among other factors. By adjusting these factors the airflow assembly 100 can be "tuned" to have a beneficial effect on the noise characteristics of the fan 212.

Figure 8:
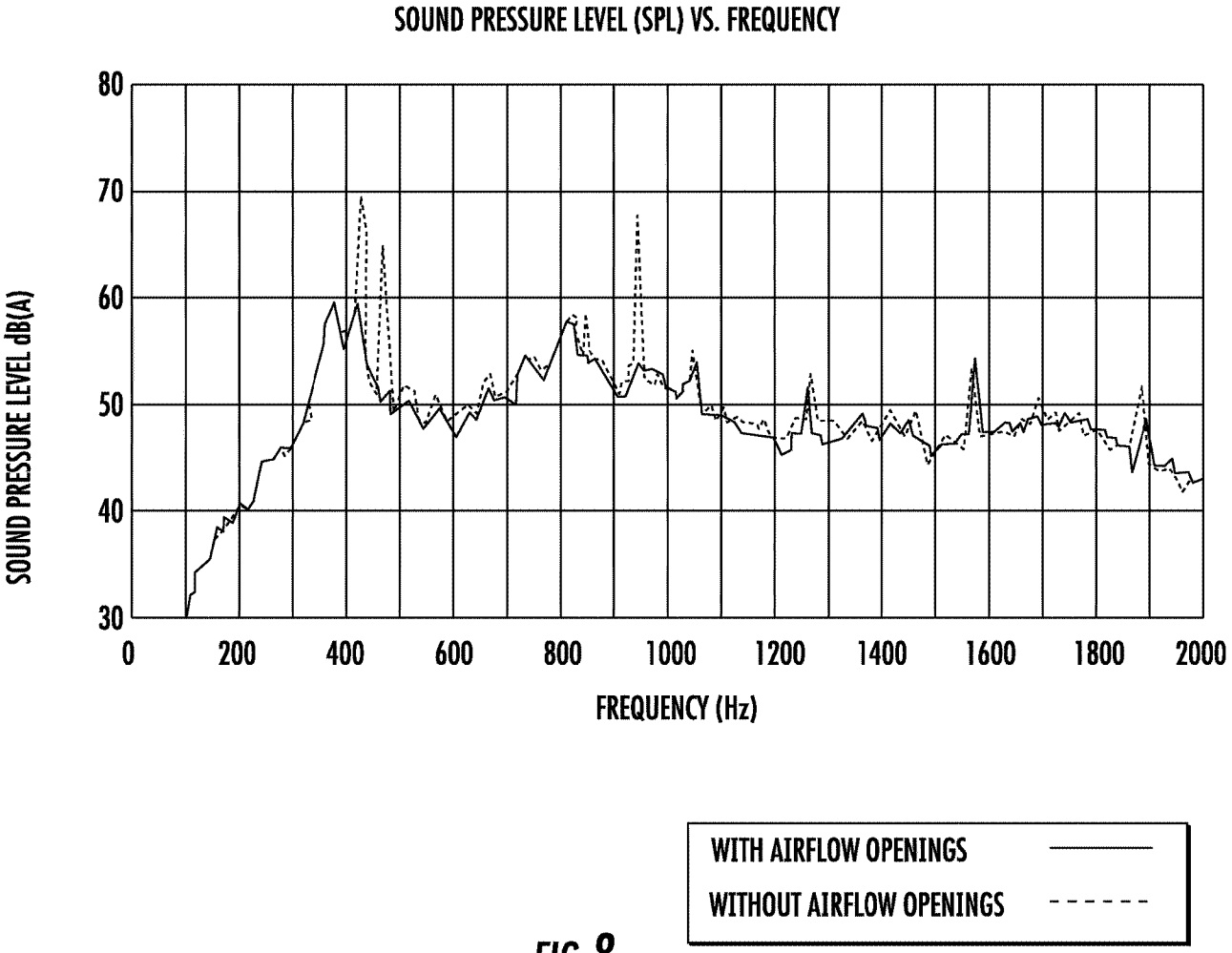
FIG. 8 is a graph of sound pressure level verses frequency of the airflow assembly of FIG. 1 and of an airflow assembly that does not include the airflow openings.

As shown in the graph of FIG. 8, the airflow openings 324 cause the airflow assembly 100 to exhibit a reduced "loudness" as compared to the loudness of an airflow assembly that does not include the airflow openings (referred to as the baseline assembly). The sound pressure level ("SPL") exhibited by the airflow assembly 100 with the fan 212 in operation and the SPL exhibited by the baseline assembly with its fan in operation is plotted for frequencies ranging from approximately zero Hz to approximately 2000 Hz. The SPL represents the sound level or the loudness of the airflow assembly 100 and the baseline assembly. The baseline assembly emits the greatest SPL at three tones approximately centered about 420 Hz, 460 Hz, and 930 Hz. The airflow openings 324 have been sized and positioned ("tuned") to reduce these tones. As shown, the airflow assembly 100 reduces the SPL of the 420 Hz tone by approximately 10 dB(A), reduces the SPL of the 460 Hz tone by approximately 14 dB(A), and reduces the SPL of the 930 Hz tone by approximately 14 dB(A), thereby reducing the overall noise level and improving the acoustical performance of the airflow assembly.

The airflow opening 324 is shown at generally the five o'clock position in FIGS. 1 and 3-5; however, in other embodiments the rim structure 224 and the airflow opening 324 may be positioned at any circumferential and/or radial location about the axis 276 that is spaced apart from the barrel 220.

The airflow assembly 100 is shown in FIG. 1 as including one of the rim structures 224, which defines one of the airflow openings 324. In other embodiments, the airflow assembly 100, includes more than one of the rim structures 224 and more than one of the airflow openings 324. In particular, the airflow assembly 100 may include between two and seven of the rim structures 224 and the airflow openings 324.

In embodiments of the airflow assembly 100, having more than one airflow opening 324, a total azimuthal extent is determined by combining the azimuthal extent 372 of each of the airflow openings. In some embodiments, the total azimuthal extent of the airflow openings 324 is greater than or equal to 10% of the fan blade tip chord 356 and less than or equal to the blade tip spacing S.

In embodiments of the airflow assembly 100, having more than airflow opening 324, each of the airflow openings is spaced apart from the axis 276 a radial distance 368, which is approximately 100% of the maximum radial extent 361 and less than or equal to 150% of the maximum radial extent.

In some embodiments it is desirable for the airflow openings 324 to be positioned on plenum 216 as closely as possible to the barrel 220. In some embodiments of the airflow assembly 100 the airflow openings 324 are formed in the barrel 220. In such an embodiment, the airflow openings 324 are not provided as a drain for liquid fluids since they positioned away from the regions of the barrel channel 304 in which gravity causes liquid fluids to collect.

Figure 11:
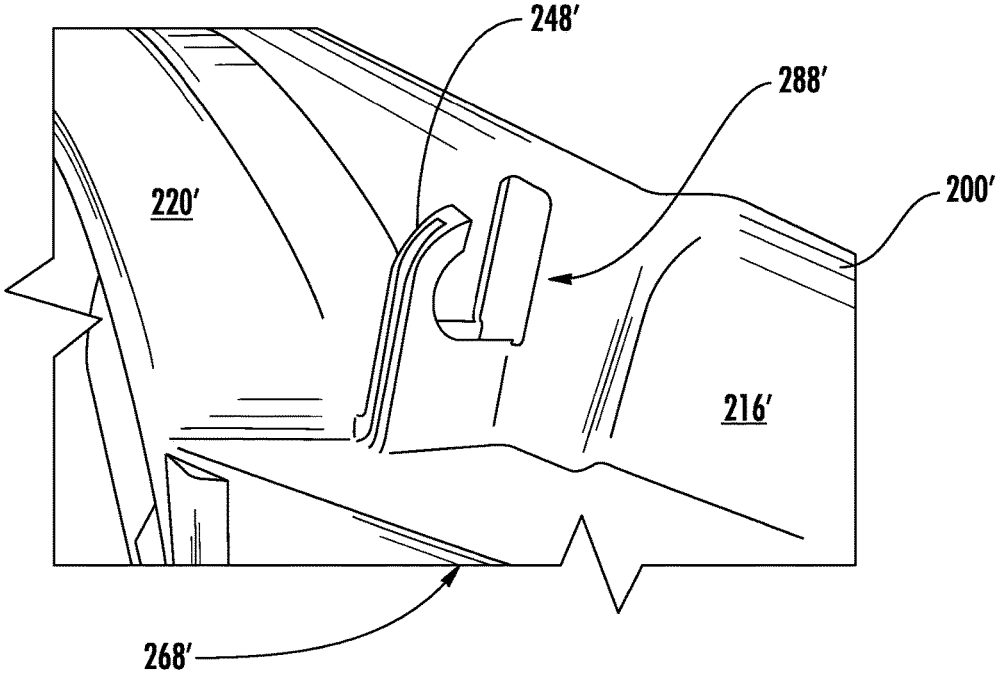
FIG. 11 shows a portion of another embodiment of the airflow assembly of FIG. 1, including a guiding structure.

As shown in FIG. 11, another embodiment of the guiding structure 248' defines an opening 288' through the plenum 216' to the plenum space 268'. The guiding structure 248'receives an element (not shown) that is to be guided, such as a tube, a wire, a wire conduit, a portion of a coolant overflow tank, and/or any other component to be guided. When the element is received by the guiding structure 248', the element occludes at least a portion of the opening 288'. To the extent that some portion of the opening 288' would not be occluded by the element, the resulting gap between the element and the guiding structure 248' that defines the opening 288' would at least be partially defined by the element.

Figure 6:
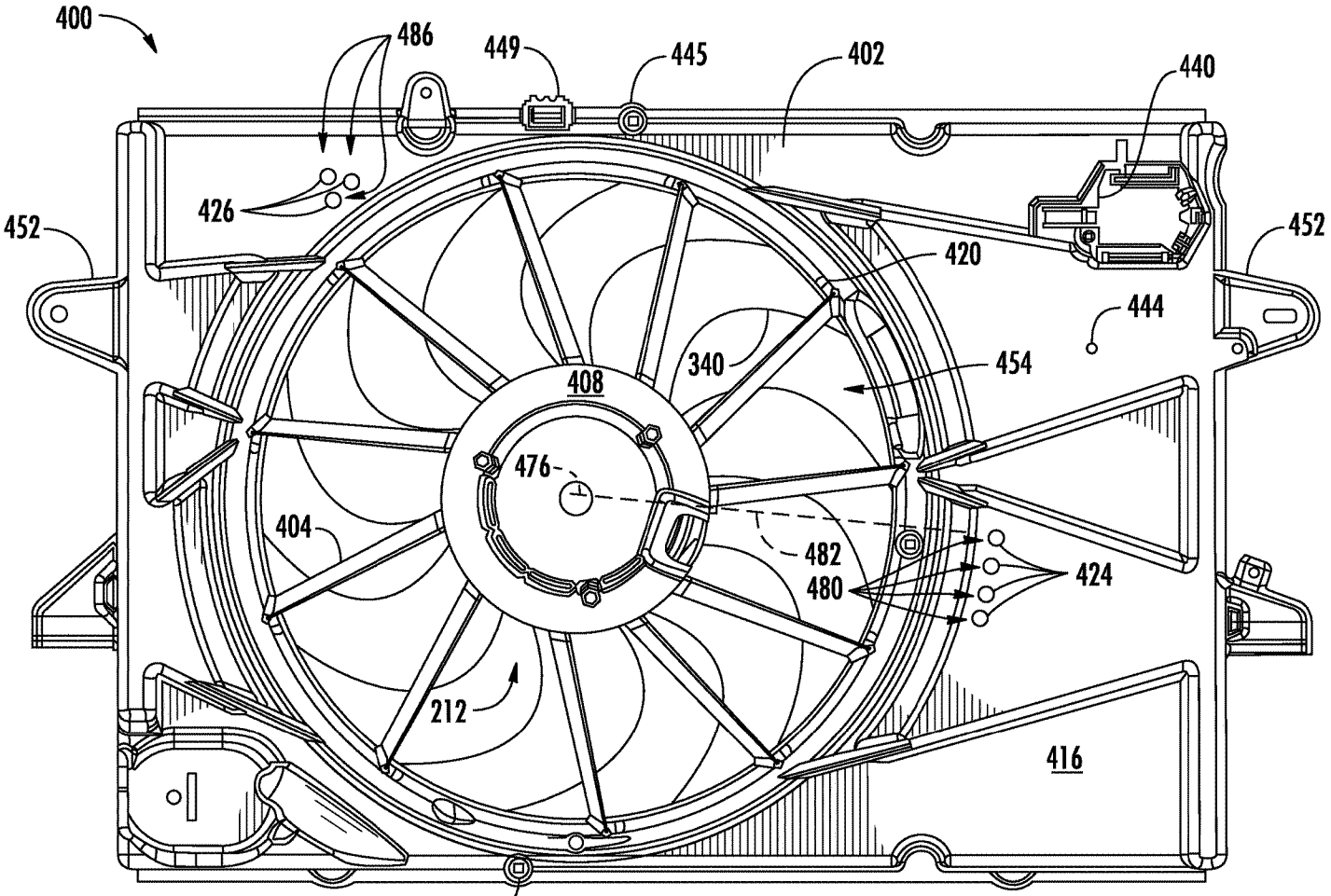
FIG. 6 is an elevational view of a downstream side of another embodiment of an airflow assembly.
Figure 7:
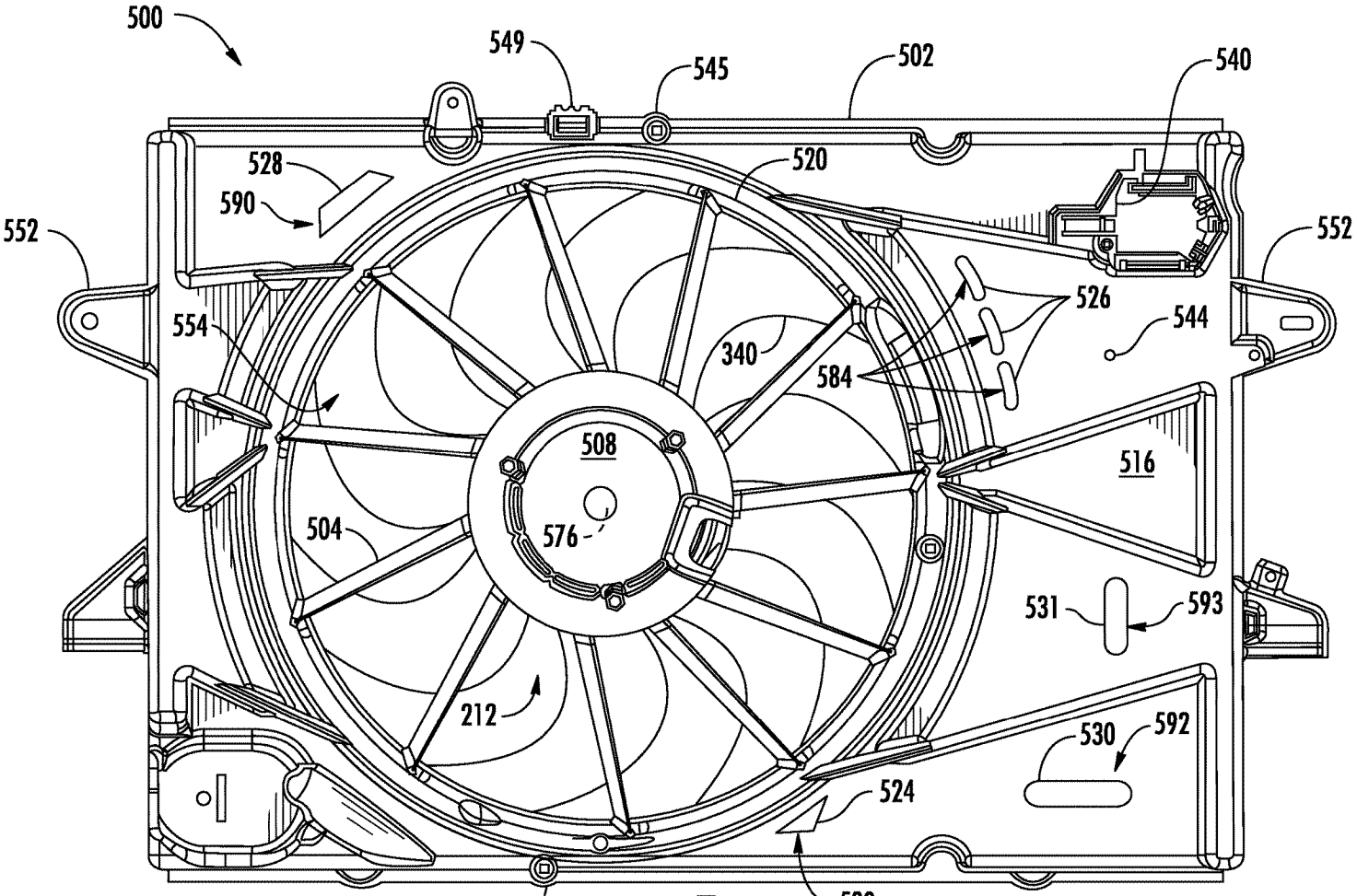
FIG. 7 is an elevational view of a downstream side of yet another embodiment of an airflow assembly.

As shown in FIGS. 6 and 7, the airflow assemblies 400, 500 include different embodiments of the rim structure 224 that have been "tuned" to change the noise generated by the airflow assembly 400, 500 in a particular way. The airflow assemblies 400, 500 are identical to the airflow assembly 100 in structure and operation except for the differences in the rim structures, as described below.

As shown in FIG. 6, the airflow assembly 400 includes a shroud 402, ribs 404, a fan support 408, and the fan 212. The shroud 400 includes a plenum 416, a barrel 420, four rim structures 424, and three rim structures 426. The plenum 416 includes a component structure 440, attachment structures 444, an attachment feature 449, bumper holders 445, and connection tabs 452. A plenum opening 454 is centered about an axis 476 (extends into and out of the page in FIG. 6) about which the blade assembly 340 rotates. The barrel 420 is generally cylindrical and is centered about the axis 476.

The rim structures 424 each solely define a generally circular airflow opening 480. The airflow openings 480 are each positioned a radial distance 482 from the axis 476. The airflow openings 480 are spaced apart from the barrel 420.

The rim structures 426 each solely define a generally circular airflow opening 486. The airflow openings 486 are spaced apart from the barrel 420.

Operation of the fan 212 generates a flow of air. A first portion of the flow of air passes through the plenum opening 454. A second portion of the flow of air passes through the airflow openings 480, 486 to improve the acoustical performance of the airflow assembly 400.

The rim structures 424, 426 are not the component structure 440, the attachment structures 444, or the guiding structures 448. Furthermore, the rim structures 424, 426 are not configured as water drain structures. In other embodiments, the rim structures 424, 426 may be positioned at any circumferential and/or radial location about the axis 476 that is spaced apart from the barrel 420. Additionally, in other embodiments the airflow assembly 400 may include any one or more of the rim structures 224, 424, 426.

As shown in FIG. 7, the airflow assembly 500 includes a shroud 502, ribs 504, a fan support 508, and the fan 212. The shroud 500 includes a plenum 516, a barrel 520, a rim structure 524, rim structures 526, a rim structure 528, a rim structure 530, and a rim structure 531. The plenum 516 includes a component structure 540, attachment structures 544, an attachment feature 549, bumper holders 545, and numerous connection tabs 552. A plenum opening 554 is centered about an axis 576 (extends into and out of the page in FIG. 7) about which the blade assembly 340 rotates. The barrel 520 is generally cylindrical and is centered about the axis 576.

The rim structure 524 solely defines one generally triangularly shaped airflow opening 580. The airflow opening 580 is spaced apart from the barrel 520.

The rim structures 526 each solely define a generally kidney-shaped airflow opening 584. The airflow openings 584 are spaced apart from the barrel 520.

The rim structure 528 solely defines one airflow opening 590 having a trapezoidal shape. The airflow opening 590 is spaced apart from the barrel 520.

The rim structure 530 solely defines one airflow opening 592 having a rounded rectangular shape. The airflow opening 592 is spaced apart from the barrel 520.

Operation of the fan 212 generates a flow of air. A first portion of the flow of air passes through the plenum opening 554. A second portion of the flow of air passes through the airflow openings 580, 584, 590, 592 to improve the acoustical performance of the airflow assembly 500.

The rim structure 531 defines one airflow opening 593 having a rounded rectangular shape. The airflow opening 593 is spaced apart from the barrel 520.

In other embodiments, the rim structures 524, 526, 528, 530, 531 may be positioned at any circumferential and/or radial location about the axis 576 that is spaced apart from the barrel 520. Additionally, in other embodiments the airflow assembly 500 may include any one or more of the rim structures 224, 424, 426, 524, 526, 528, 530, 531.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. An airflow assembly, comprising:

a fan having a number of fan blades;

a shroud including (i) a plenum defining a plenum opening located adjacent to said number of fan blades, said plenum configured to guide an airflow through said plenum opening in a first direction, and (ii) a barrel extending from said plenum so as to surround said plenum opening, wherein said plenum further defines at least one airflow opening spaced apart from said plenum opening and configured to pass at least a portion of said airflow therethrough in a second direction that is opposite to said first direction;

a plurality of ribs, each of said plurality of ribs extending inwardly from said barrel; and a fan support attached to said plurality of ribs and configured to support said fan;

wherein said at least one airflow opening is not an attachment structure or a guiding structure, wherein said at least one airflow opening is not configured to receive a fastening member, and wherein said at least one airflow opening does not function as a water drain.

2. The airflow assembly of claim 1, wherein:

said at least one airflow opening includes X airflow openings, and $$2 \leq X \leq 7.$$

3. The airflow assembly of claim 1, wherein:

said fan is configured to rotate said number of fan blades in a path of movement about an axis to define a cylinder, said at least one airflow opening is spaced apart from said axis by a radial distance, said radial distance is equal to RD, said cylinder defines a diameter, said diameter is equal to D, $$D/2 = R\text{max}, \text{ and}$$

$$1.01R\text{max} \leq \text{RD} \leq 1.50R\text{max}.$$

4. The airflow assembly of claim 3, wherein:

a radial extent of said at least one airflow opening is equal to RE, and $$\beta = \text{RE}/R\text{max}$$

$$0.03 \leq \beta \leq 0.30.$$

5. The airflow assembly of claim 1, wherein:

said number of fan blades includes B individual fan blades,

360/B=an average azimuthal blade tip spacing, said average azimuthal blade tip spacing is equal to S, each terminal end of said number of fan blades defines a fan blade tip chord, said fan blade tip chord is equal to C, an azimuthal extent of said at least one airflow opening is equal to AE, and $$0.1C \leq \text{AE} \leq S.$$

6. The airflow assembly of claim 1, wherein:

said number of fan blades includes B individual fan blades,

360/B=an average azimuthal blade tip spacing, said average azimuthal blade tip spacing is equal to S, each terminal end of said number of fan blades defines a fan blade tip chord, said fan blade tip chord is equal to C, said at least one airflow opening includes a plurality of airflow openings, an azimuthal extent of said plurality of airflow openings is equal to AE, and $$0.1C \leq \text{AE} \leq S.$$

7. The airflow assembly of claim 1, wherein:

said plenum includes a rim structure, and said at least one airflow opening is defined solely by said rim structure.

8. The airflow assembly of claim 1, wherein:

said fan is configured to rotate said number of fan blades in a path of movement about an axis to define a cylinder, said at least one airflow opening is spaced apart from said axis by a radial distance, said radial distance is equal to RD, said cylinder defines a diameter, said diameter is equal to D, $$D/2 = R\text{max}, \text{ and}$$

$$1.01R\text{max} \leq \text{RD} \leq 1.20R\text{max}.$$

9. An airflow assembly, comprising:

a fan having a number of fan blades, said fan being configured to rotate said number of fan blades so as to generate a flow of air;

a shroud including (i) a plenum defining a plenum opening, said plenum configured to guide at least a portion of said flow of air though said plenum opening in a first direction as an airflow, and (ii) a barrel extending from said plenum so as to define a barrel space that is aligned with said plenum opening, wherein said plenum includes a rim structure that defines at least one airflow opening configured to pass at least a portion of said airflow therethrough in a second direction that is opposite to said first direction, said plenum opening being spaced apart from said at least one airflow opening; and a plurality of ribs, each of said plurality of ribs extending inwardly from said barrel; and a fan support attached to said plurality of ribs and configured to support said fan, wherein said at least one airflow opening is spaced apart from said barrel, and wherein said at least one airflow opening is defined solely by said rim structure.

10. The airflow assembly of claim 9, wherein:

said at least one airflow opening includes X airflow openings, and $$2 \leq X \leq 7.$$

11. The airflow assembly of claim 9, wherein:

said fan is configured to rotate said number of fan blades in a path of movement about an axis to define a cylinder, said at least one airflow opening is spaced apart from said axis by a radial distance, said radial distance is equal to RD, said cylinder defines a diameter, said diameter is equal to D, $$D/2 = R\text{max}, \text{ and}$$

$$1.01R\text{max} \leq \text{RD} \leq 1.30R\text{max}.$$

12. The airflow assembly of claim 11, wherein:

a radial extent of said at least one airflow opening is equal to RE, and $$\beta = \text{RE}/R\text{max}$$

$$0.03 \leq \beta \leq 0.30.$$

13. The airflow assembly of claim 9, wherein:

said number of fan blades includes B individual fan blades,

360/B=an average azimuthal blade tip spacing, said average azimuthal blade tip spacing is equal to S, each terminal end of said number of fan blades defines a fan blade tip chord, said fan blade tip chord is equal to C, an azimuthal extent of said at least one airflow opening is equal to AE, and $$0.1C \leq \text{AE} \leq S.$$

14. The airflow assembly of claim 9, wherein:

said number of fan blades includes B individual fan blades,

360/B=an average azimuthal blade tip spacing, said average azimuthal blade tip spacing is equal to S, each terminal end of said number of fan blades defines a fan blade tip chord, said fan blade tip chord is equal to C, said at least one airflow opening includes a plurality of airflow openings, an azimuthal extent of said plurality of airflow openings is equal to AE, and $$0.1C \leq \text{AE} \leq S.$$

15. The airflow assembly of claim 9, wherein said flow of air flows through both said plenum opening and said airflow opening.

16. The airflow assembly of claim 9, wherein:

said plenum defines a plenum space, said airflow passes from said plenum space to outside of said plenum space through said plenum opening, and said portion of said airflow passes from outside of said plenum space to said plenum space through said at least one airflow opening.

17. The airflow assembly of claim 9, wherein:

said fan is configured to rotate said number of fan blades in a path of movement about an axis to define a cylinder, said at least one airflow opening is spaced apart from said axis by a radial distance, said radial distance is equal to RD, said cylinder defines a diameter, said diameter is equal to D, $$D/2 = R\text{max}, \text{ and}$$

$$1.01R\text{max} \leq \text{RD} \leq 1.1R\text{max}.$$

18. The airflow assembly of claim 1, wherein said at least one airflow opening is unoccluded by any structure of the airflow assembly during operation of the airflow assembly.

19. The airflow assembly of claim 9, wherein said at least one airflow opening is unoccluded by any structure of the airflow assembly during operation of the airflow assembly.

* * * * *